US006503602B1

(12) United States Patent
Crosby

(10) Patent No.: US 6,503,602 B1
(45) Date of Patent: Jan. 7, 2003

(54) DRYER FABRIC WITH REINFORCED EDGES

(75) Inventor: T. Payton Crosby, Waterboro, SC (US)

(73) Assignee: AstenJohnson, Inc., Charleston, SC (US)

( * ) Notice: Subject to any disclaimer, the term of this patent is extended or adjusted under 35 U.S.C. 154(b) by 96 days.

(21) Appl. No.: 09/626,016

(22) Filed: Jul. 26, 2000

(51) Int. Cl.[7] ..... B32B 23/02

(52) U.S. Cl. ..... 428/193; 442/181; 442/239; 161/902

(58) Field of Search ..... 428/193; 442/181, 442/239; 162/902

(56) References Cited

U.S. PATENT DOCUMENTS

| | | | | |
|---|---|---|---|---|
| 660,027 | A | | 10/1900 | Proctor |
| 1,854,693 | A | | 4/1932 | Dickie et al. |
| 2,207,609 | A | | 7/1940 | Buchanan |
| 2,597,888 | A | | 5/1952 | Miller |
| 2,659,958 | A | | 11/1953 | Johnson |
| 3,076,252 | A | | 2/1963 | Hofmann |
| 3,126,677 | A | | 3/1964 | Herrmann |
| 3,399,111 | A | | 8/1968 | Beaumont et al. |
| 3,523,867 | A | | 8/1970 | MacBean |
| 3,575,752 | A | | 4/1971 | Carpenter |
| 3,697,357 | A | | 10/1972 | Obeda |
| 3,874,963 | A | | 4/1975 | Barger |
| 4,090,897 | A | | 5/1978 | Minick |
| 4,373,979 | A | | 2/1983 | Planeta |
| 4,381,612 | A | | 5/1983 | Shank |
| 4,384,021 | A | | 5/1983 | Aoyama |
| 4,427,734 | A | | 1/1984 | Johnson |
| 4,676,369 | A | * | 6/1987 | Borel ..... 428/193 |
| 4,798,760 | A | | 1/1989 | Diaz-Kotti |
| 5,084,326 | A | | 1/1992 | Vöhringer |
| 5,085,917 | A | | 2/1992 | Hodnett, III |
| 5,506,033 | A | | 4/1996 | Smith |
| 5,609,936 | A | | 3/1997 | Kohler et al. |

FOREIGN PATENT DOCUMENTS

| | | |
|---|---|---|
| CA | 379429 | 2/1939 |
| CA | 537594 | 2/1957 |
| CA | 589075 | 12/1959 |

* cited by examiner

*Primary Examiner*—Elizabeth M. Cole
(74) *Attorney, Agent, or Firm*—Volpe and Koenig, P.C.

(57) ABSTRACT

A papermakers fabric is reinforced along its edges by bonding a webbing thereto. The fabric may be made of various materials and weaves. The webbing is made of thermoplastic material, and also may be made of various material to various thicknesses. The webbing is bonded to one or both surfaces of the fabric at its edge by ultrasonic welding.

14 Claims, 2 Drawing Sheets

DRYER FABRIC WITH REINFORCED EDGES

BACKGROUND

1. Field of the Invention

The present invention generally relates to a woven fabric for use on a papermaking machine. More particularly it relates to a fabric for use in drying the paper web. Most particularly, it relates to a dryer fabric having reinforced edges.

2. Description of the Related Art

Fabrics used in papermaking machines are used as endless belts for carrying the paper through various stages of manufacture. The fabrics are either joined endless by a seam or woven endless. In either case, the fabrics must be durable to minimize the down time and loss of production associated with a fabric change. Because the edges are subject to damage and wear due to repeated contact with machine parts and guide rails, edge protection has been a concern. Recurrent problems found in papermaking fabrics include premature edge wear and unraveling at the edges. Unprotected edges also lead to reduced fabric stability. Sealing the fabric edges helps to prevent yarn shifting throughout the body of the fabric. Paper machine guide system suppliers have long advocated increasing the mass of the fabric edge as a means to prolong the life of the fabric selvage.

Typically, the fabric edges have been protected by application of an edge sealant. Popular sealants include polyurethane and epoxy urethanes. Ultraviolet light curable silicone and radiation curable coatings also have been used to protect fabric edges. Problems associated with these sealants include long drying times, cost and application problems. Additionally, these types of sealants do not fuse the threads at the fabric edge. Therefore, the fabric may suffer from stray threads or unraveling.

In the past, rather than sealing the edge with a coating, the belt edge has been reinforced by stitching additional, more durable material along the edge or weaving special threads into the edge. The latter technique is the common approach in papermaking fabrics. In some cases, stranded, more flexible warp yarns have been used in the fabric selvage to reduce the danger of edge cracking. In other instances, special yarns have been woven into the edge for treatment with heat or chemicals. When exposed to the appropriate element, the special yarns fuse or bond together to create a more stable finished selvage. One such method uses solvents to partially dissolve the edge fibers and cause them to fuse together. Similarly, ultrasonic welding has been used to fuse a substitute thermoplastic warp thread to edge yarns where a standard warp thread has been removed. In other applications, ultrasonic bonding has been improved by the addition of a thermoplastic web between two material layers. Thermoplastic webs have more traditionally been heat fused between a base fabric and batt material to reduce compaction between the two layers.

Papermaking machines continually improve, becoming faster and demanding better, more durable fabrics. The papermaking art demands constant evolution of papermaking fabrics and will benefit from reinforcement of the papermaking fabric edge according to the present invention.

SUMMARY OF THE INVENTION

The present invention concerns a papermaking fabric having edges reinforced with a webbing which is bonded to the papermaking surface or the machine surface or both. Longitudinal machine direction edges, as well as the cross machine direction seam edges of a flat woven fabric, may be reinforced by application of the webbing.

BRIEF DESCRIPTION OF THE DRAWINGS

Throughout the various figures, like elements are designated by the same reference numerals.

DETAILED DESCRIPTION

Figure 1:
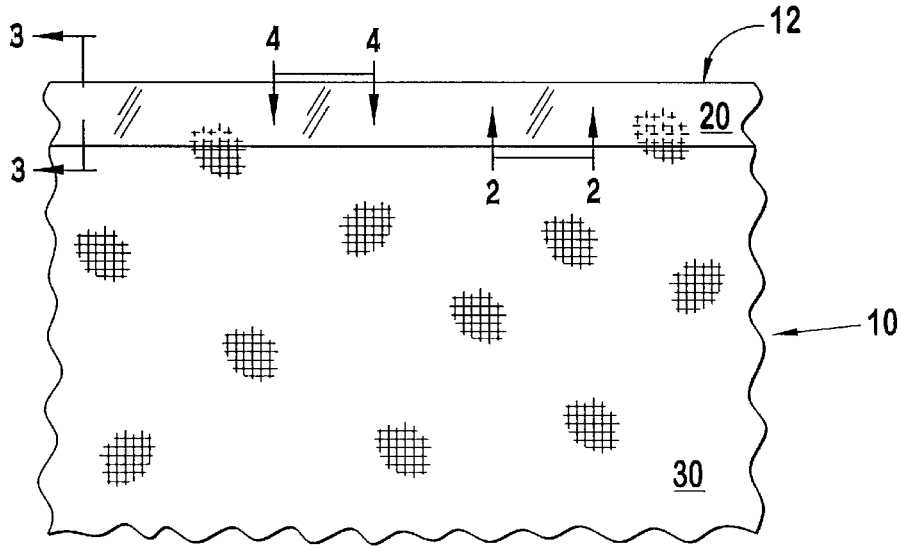
FIG. 1 is a partial plan view of a fabric having reinforced edges according to the invention.

A papermaking fabric having reinforced edges is shown in FIG. 1. The base fabric may be woven flat or endless. In either event, the fabric will have machine direction (MD) yarns and cross-machine direction (CMD) yarns as is well known in the art. Any of a variety of weaves may be used depending on the application. The fabrics may be of any permeability. Regardless of the type of weave or fabric, all of them will have two opposed edges or selvages running in the machine direction. Flat woven fabrics will additionally have CMD edges that will form a seam which renders the fabric endless. All of the edges are subject to wear and unraveling which limit the useable life of the fabric and therefore would benefit from reinforcement in accordance with this invention.

Figure 2:
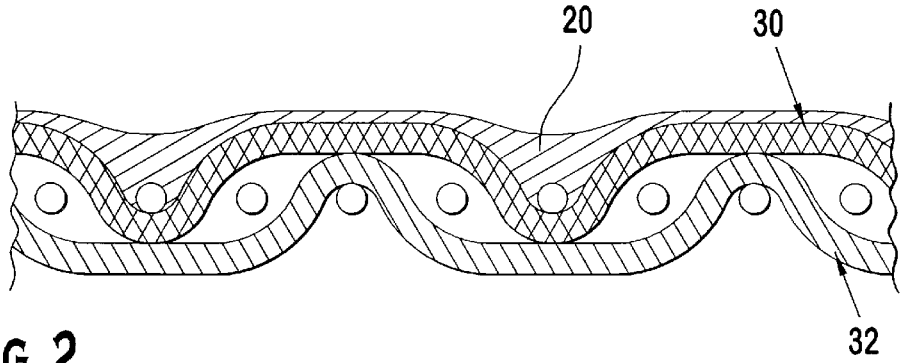
FIG. 2 is a cross-sectional view taken along line 2—2 of FIG. 1.
Figure 3:
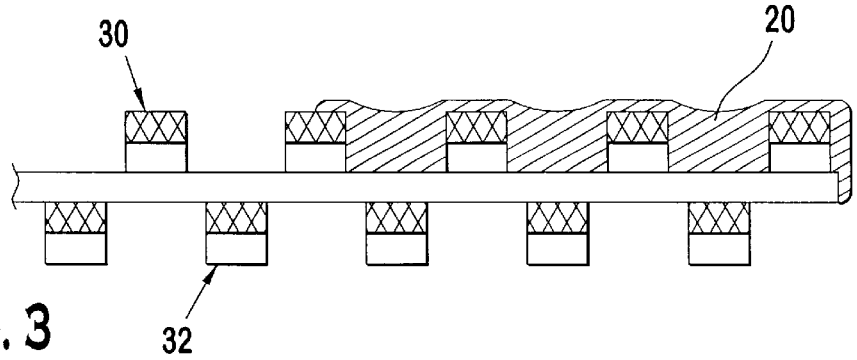
FIG. 3 is a cross-sectional view taken along line 3—3 of FIG. 1.
Figure 4:
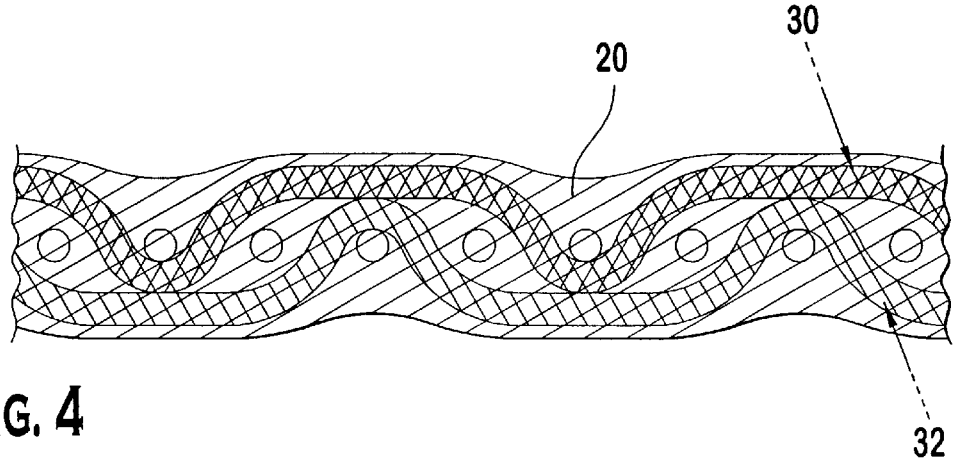
FIG. 4 is an elevational view of the edge of the fabric as seen along line 4—4 of FIG. 1.
Figure 5:
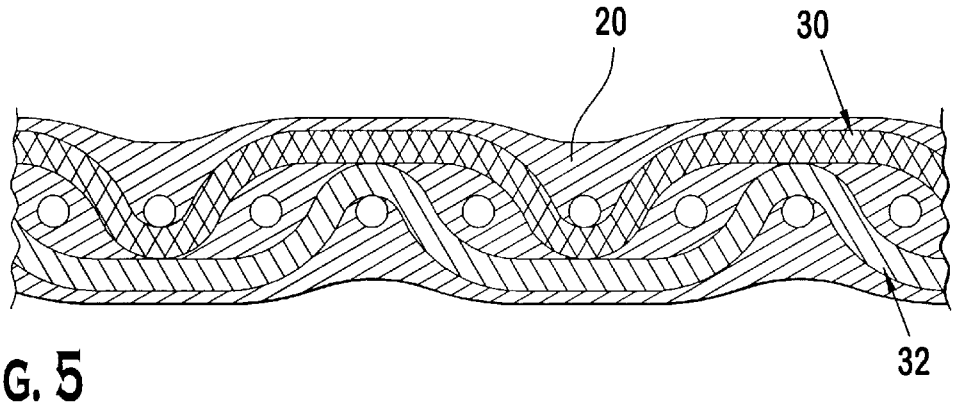
FIG. 5 is a cross-sectional view of an alternative embodiment as seen along line 2—2 of FIG. 1.
Figure 6:
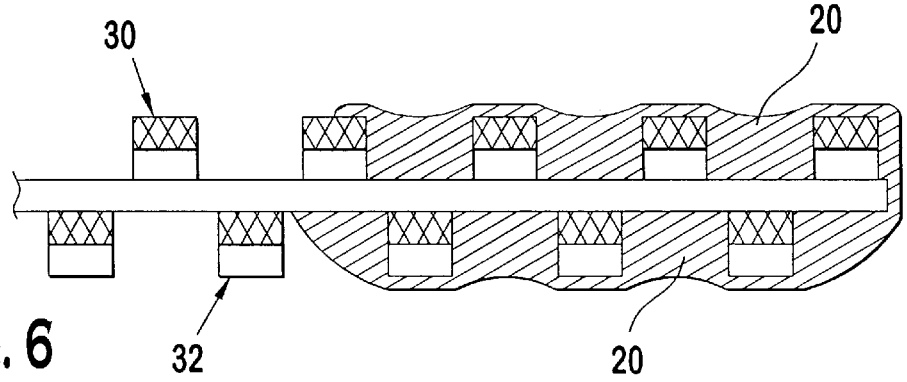
FIG. 6 is a cross-sectional view of an alternative embodiment as seen along line 3—3 of FIG. 1.

A web 20 comprising thermoplastic material is bonded to the edges 12 of the fabric 10, preferably through ultrasonic welding techniques. Preferably, the web is woven from thermoplastic monofilament. Because the web bonds with the yarns of the fabric edge, it can be relatively narrow compared to the fabric width. The width of the web will naturally depend on the nature of the base fabric, some of which are inherently less stable than others. The web may be applied to only one fabric surface, as in FIGS. 2 and 3, or to both fabric surfaces, as in FIGS. 5 and 6. In either case, the web seals the yarn ends as seen in FIGS. 3–5. The bonded web also adds mass to the selvage which allows it to better withstand the ravages of the papermaking machine. Standard ultrasonic equipment can be used without modification to bond the web 20 to the fabric 10. Depending upon the application, the webbing 20 may be welded to the fabric surface 30 or, with increased ultrasonic intensity, may be melted or softened to flow into the interstices of the woven fabric edge 12. This is generally preferred because the webbing material becomes anchored in the fabric, locking loose or stray yarns in place along the edge. In addition, this maintains the original fabric caliper and does not substantially change the surface of the fabric.

The web 20 does not need to flow completely into the fabric edge 12 to be effective. However, webs designed for a partial flow are preferably woven to impart surface characteristics complimentary to the base fabric. The partially melted web fills enough of the fabric interstices to effectively seal the yarns in place, while maintaining flexibility and retaining some of its own surface characteristics. The yarns of web 20 may be made of a co-extruded, or other bi-component yarn that has only a small portion of a lower melting point component about a core yarn that will preserve the predetermined structure of the web, whether woven or nonwoven. However, it will be recognized by those skilled in the art from the present disclosure that the yarns of the web 20 may be extruded from a single material.

Welding of the monofilament webbing to either or both fabric surfaces 30, 32 also stabilizes the edge yarns. In welding, sufficient ultrasonically generated energy is applied to bond the web to the surface yarns, but not enough to cause the web to melt into the fabric interstices. The monofilament web will not be bulky, and holds the edge yarns in place without substantially adding to the fabric caliper or thickness, as in more traditional methods.

The yarns of the web 20 may be made of polyester, polyolefin, polyethylene, or any other suitable material for papermaking fabrics. In a preferred embodiment, the yarns of the web 20 have a diameter of approximately 0.0076 inches, and are preferably in the range of about 0.002 to 0.010 inches. However, those skilled in the art will understand that the diameter of the yarns of the web 20 may change depending upon the caliper of the fabric 12 to which the web 20 is being applied. Preferably, the web 20 is woven in a plain weave or a crows foot weave. However, those skilled in the art will recognize from the present disclosure that other weave patterns may be utilized, if desired.

In a preferred embodiment, the web 20 was applied along the edges 12 on both sides of a fabric 10 having a caliper of 0.065 inches and ultrasonically bonded in place. The resulting fabric edges had a caliper of 0.075 inches.

It will be appreciated by those skilled in the art that changes could be made to the preferred embodiment of the invention described above without departing from the broad inventive concept thereof. It is understood, therefore, that the invention is not limited to the particular embodiment disclosed, and is intended to cover modifications within the spirit and scope of the present invention as defined by the appended claim.

I claim:

1. A papermaking fabric for use on a paper making machine having a paper sheet carrying surface and a machine contact surface, and opposed machine direction edges which have portions thereof in contact with paper machine elements, characterized by:

a monofilament web affixed to the opposed edges to reinforce and protect the edges while maintaining approximately the same fabric caliper.

2. A fabric according to claim 1, wherein monofilament of the monofilament web are comprised of a thermoplastic material.

3. A fabric according to claim 2, wherein the web is woven.

4. A fabric according to claim 1, wherein the monofilament web is applied to the paper sheet carrying surface.

5. A fabric according to claim 1, wherein the monofilament web is applied to the machine contact surface.

6. A fabric according to claim 1, wherein the web is applied to both surfaces.

7. A fabric according to claim 1, wherein the web is bonded to the fabric by ultrasonic welding.

8. A fabric according to claim 7, wherein the bonding causes the web to partially fill the fabric edge.

9. A fabric according to claim 8, wherein the bonding causes the web to completely fill the fabric edges.

10. A fabric according to claim 2, wherein the monofilaments are a co-extruded bi-component yarn comprised of a lower melt component and a higher melt point component.

11. A fabric according to claim 2, wherein the monofilaments are extruded from a single component.

12. A fabric according to claim 11, wherein the single component comprises a polyester, a polyolefin, or a polyethylene.

13. A fabric according to claim 2, wherein a diameter of the monofilaments is between 0.002 inches and 0.010 inches.

14. A fabric according to claim 3, wherein the monofilament has a weave pattern that is a plain weave or a crow's foot weave.

* * * * *

UNITED STATES PATENT AND TRADEMARK OFFICE

CERTIFICATE OF CORRECTION

PATENT NO. : 6,503,602 B1
DATED : January 7, 2003
INVENTOR(S) : T. Payton Crosby It is certified that error appears in the above-identified patent and that said Letters Patent is hereby corrected as shown below:

Column 4,
Line 10, after the word "wherein", delete the word "monofilament", and insert therefor -- monofilaments --.

Signed and Sealed this

Second Day of September, 2003

JAMES E. ROGAN
*Director of the United States Patent and Trademark Office*